US008276675B2

(12) United States Patent
Williamson et al.

(10) Patent No.: US 8,276,675 B2
(45) Date of Patent: Oct. 2, 2012

(54) SYSTEM AND METHOD FOR SERVICING A WELLBORE

(75) Inventors: Jimmie Robert Williamson, Carrollton, TX (US); Perry Shy, Southlake, TX (US); Roger Watson, Weatherford, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 216 days.

(21) Appl. No.: 12/539,392

(22) Filed: Aug. 11, 2009

(65) Prior Publication Data

US 2011/0036590 A1 Feb. 17, 2011

(51) Int. Cl.
*E21B 34/12* (2006.01)
*E21B 43/16* (2006.01)

(52) U.S. Cl. ..... 166/383; 166/306; 166/319; 166/334.4

(58) Field of Classification Search ..... 166/318, 166/319, 306, 383, 169, 334.1, 334.4
See application file for complete search history.

(56) References Cited

U.S. PATENT DOCUMENTS

| | | | | |
|---|---|---|---|---|
| 2,201,290 | A | | 5/1940 | Greene |
| 2,913,051 | A | | 11/1959 | Lister |
| 3,054,415 | A | | 9/1962 | Baker et al. |
| 3,057,405 | A | | 10/1962 | Mallinger |
| 3,216,497 | A | | 11/1965 | Howard et al. |
| 3,434,537 | A | | 3/1969 | Zandmer |
| 3,768,556 | A | | 10/1973 | Baker |
| 4,081,990 | A | | 4/1978 | Chatagnier |
| 4,105,069 | A | | 8/1978 | Baker |
| 4,109,725 | A | | 8/1978 | Williamson et al. |
| 4,150,994 | A | | 4/1979 | Maternaghan |
| 4,417,622 | A | * | 11/1983 | Hyde ..... 166/264 |
| 4,469,136 | A | | 9/1984 | Watkins |
| 4,673,039 | A | | 6/1987 | Mohaupt |
| 4,714,117 | A | | 12/1987 | Dech |
| 4,893,678 | A | * | 1/1990 | Stokley et al. ..... 166/374 |
| 5,125,582 | A | | 6/1992 | Surjaatmadja et al. |
| 5,127,472 | A | | 7/1992 | Watson et al. |
| 5,180,016 | A | | 1/1993 | Ross et al. |
| 5,323,856 | A | | 6/1994 | Davis et al. |
| 5,325,917 | A | | 7/1994 | Szarka |
| 5,325,923 | A | | 7/1994 | Surjaatmadja et al. |

(Continued)

FOREIGN PATENT DOCUMENTS

GB 2323871 A 10/1998

(Continued)

OTHER PUBLICATIONS

Office Action dated Dec. 22, 2009 (18 pages), U.S. Appl. No. 12/139,604, filed Jun. 16, 2008.

(Continued)

*Primary Examiner* — William P Neuder
(74) *Attorney, Agent, or Firm* — John W. Wustenberg; Conley Rose, P.C.

(57) ABSTRACT

A wellbore servicing system, comprising a first sleeve system, the first sleeve system comprising a first sliding sleeve at least partially carried within a first ported case, the first sleeve system being selectively restricted from movement relative to the first ported case by a first restrictor while the first restrictor is enabled, and a first delay system configured to selectively restrict movement of the first sliding sleeve relative to the ported case while the restrictor is disabled.

26 Claims, 8 Drawing Sheets

U.S. PATENT DOCUMENTS 5,361,856 A 11/1994 Surjaatmadja et al.
5,366,015 A 11/1994 Surjaatmadja et al.
5,381,862 A 1/1995 Szarka et al.
5,396,957 A 3/1995 Surjaatmadja et al.
5,425,424 A 6/1995 Reinhardt et al.
5,484,016 A 1/1996 Surjaatmadja et al.
5,494,103 A 2/1996 Surjaatmadja et al.
5,494,107 A 2/1996 Bode
5,499,678 A 3/1996 Surjaatmadja et al.
5,499,687 A 3/1996 Lee
5,533,571 A 7/1996 Surjaatmadja et al.
5,765,642 A 6/1998 Surjaatmadja
5,826,661 A 10/1998 Parker et al.
5,865,252 A 2/1999 van Petegem et al.
5,944,105 A 8/1999 Nguyen
5,947,205 A 9/1999 Shy
6,006,838 A 12/1999 Whiteley et al.
6,116,343 A 9/2000 Van Petegem et al.
6,119,783 A 9/2000 Parker et al.
6,152,232 A 11/2000 Webb et al.
6,167,974 B1 1/2001 Webb
6,189,618 B1 2/2001 Beeman et al.
6,216,785 B1 4/2001 Achee, Jr. et al.
6,244,342 B1 6/2001 Sullaway et al.
6,253,861 B1 * 7/2001 Carmichael et al. ..... 175/237
6,286,599 B1 9/2001 Surjaatmadja et al.
6,318,470 B1 11/2001 Chang et al.
6,336,502 B1 1/2002 Surjaatmadja et al.
6,343,658 B2 2/2002 Webb
6,422,317 B1 7/2002 Williamson, Jr.
6,520,257 B2 2/2003 Allamon et al.
6,543,538 B2 4/2003 Tolman et al.
6,571,875 B2 6/2003 Bissonnette et al.
6,634,428 B2 10/2003 Krauss et al.
6,662,874 B2 12/2003 Surjaatmadja et al.
6,662,877 B2 12/2003 Patel
6,719,054 B2 4/2004 Cheng et al.
6,722,427 B2 4/2004 Gano et al.
6,725,933 B2 4/2004 Middaugh et al.
6,769,490 B2 8/2004 Allamon et al.
6,776,238 B2 8/2004 Dusterhoft et al.
6,779,607 B2 8/2004 Middaugh et al.
6,789,619 B2 9/2004 Carlson et al.
6,802,374 B2 10/2004 Edgar et al.
6,907,936 B2 * 6/2005 Fehr et al. ..... 166/387
6,938,690 B2 9/2005 Surjaatmadja
6,997,252 B2 2/2006 Porter et al.
6,997,263 B2 2/2006 Campbell et al.
7,013,971 B2 3/2006 Griffith et al.
7,021,384 B2 4/2006 Themig
7,021,389 B2 4/2006 Bishop et al.
7,055,598 B2 6/2006 Ross et al.
7,066,265 B2 6/2006 Surjaatmadja
7,090,153 B2 8/2006 King et al.
7,096,954 B2 8/2006 Weng et al.
7,108,067 B2 9/2006 Themig et al.
7,134,505 B2 11/2006 Fehr et al.
7,159,660 B2 1/2007 Justus
7,168,493 B2 1/2007 Eddison
7,195,067 B2 3/2007 Manke et al.
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,252,147 B2 8/2007 Badalamenti et al.
7,252,152 B2 8/2007 LoGiudice et al.
7,273,099 B2 9/2007 East, Jr. et al.
7,278,486 B2 10/2007 Alba et al.
7,287,592 B2 10/2007 Surjaatmadja et al.
7,290,611 B2 11/2007 Badalamenti et al.
7,296,625 B2 11/2007 East, Jr.
7,303,008 B2 12/2007 Badalamenti et al.
7,306,043 B2 12/2007 Toekje et al.
7,322,412 B2 1/2008 Badalamenti et al.
7,322,417 B2 1/2008 Rytlewski et al.
7,325,617 B2 2/2008 Murray
7,337,844 B2 3/2008 Surjaatmadja et al.
7,343,975 B2 3/2008 Surjaatmadja et al.
7,353,878 B2 4/2008 Themig
7,353,879 B2 4/2008 Todd et al.
7,377,321 B2 5/2008 Rytlewski
7,377,322 B2 5/2008 Hofman
7,385,523 B2 6/2008 Thomeer et al.
7,387,165 B2 6/2008 Lopez de Cardenas et al.
7,398,825 B2 7/2008 Nguyen et al.
7,416,029 B2 8/2008 Telfer et al.
7,419,002 B2 9/2008 Dybevik et al.
7,422,060 B2 9/2008 Hammami et al.
7,431,090 B2 10/2008 Surjaatmadja et al.
7,431,091 B2 10/2008 Themig et al.
7,464,764 B2 12/2008 Xu et al.
7,478,676 B2 1/2009 East, Jr. et al.
7,503,398 B2 3/2009 LoGiudice et al.
7,506,689 B2 3/2009 Surjaatmadja et al.
7,510,010 B2 3/2009 Williamson
7,510,017 B2 3/2009 Howell et al.
7,520,327 B2 4/2009 Surjaatmadja
7,527,103 B2 5/2009 Huang et al.
7,571,766 B2 8/2009 Pauls et al.
7,617,871 B2 11/2009 Surjaatmadja et al.
7,644,772 B2 1/2010 Avant et al.
7,673,673 B2 3/2010 Surjaatmadja et al.
7,703,510 B2 4/2010 Xu
7,740,072 B2 6/2010 Surjaatmadja
7,740,079 B2 6/2010 Clayton et al.
7,775,285 B2 8/2010 Surjaatmadja et al.
7,779,906 B2 8/2010 Porter et al.
7,849,924 B2 12/2010 Surjaatmadja et al.
7,866,408 B2 1/2011 Allison et al.
7,870,907 B2 1/2011 Lembcke et al.
7,878,255 B2 2/2011 Howell et al.
7,946,340 B2 5/2011 Surjaatmadja et al.
7,963,331 B2 6/2011 Surjaatmadja et al.
8,162,050 B2 4/2012 Roddy et al.
8,191,625 B2 6/2012 Porter et al.
2003/0029611 A1 2/2003 Owens
2006/0086507 A1 4/2006 Surjaatmadja et al.
2006/0124317 A1 6/2006 Telfer
2006/0157257 A1 7/2006 Ross et al.
2007/0095573 A1 5/2007 Telfer
2007/0102156 A1 5/2007 Nguyen et al.
2007/0261851 A1 11/2007 Surjaatmadja
2007/0272411 A1 11/2007 Lopez de Cardenas et al.
2007/0284114 A1 12/2007 Swor et al.
2008/0000637 A1 1/2008 McDaniel et al.
2008/0060810 A9 3/2008 Nguyen et al.
2008/0093080 A1 4/2008 Palmer et al.
2008/0135248 A1 6/2008 Talley et al.
2008/0156496 A1 7/2008 East
2008/0202764 A1 8/2008 Clayton et al.
2008/0210429 A1 9/2008 McMillin et al.
2008/0264641 A1 10/2008 Slabaugh et al.
2008/0302538 A1 12/2008 Hofman
2009/0008083 A1 1/2009 Themig et al.
2009/0014168 A1 1/2009 Tips et al.
2009/0095486 A1 4/2009 Williamson, Jr.
2010/0000727 A1 1/2010 Webb et al.
2010/0044041 A1 2/2010 Smith et al.
2011/0108272 A1 5/2011 Watson et al.
2012/0061105 A1 3/2012 Neer et al.

FOREIGN PATENT DOCUMENTS

GB 2415213 B 1/2009
WO 2008070051 A2 6/2008
WO 2008070051 A3 6/2008
WO 2008070051 B1 6/2008
WO 2008093047 A1 8/2008
WO 2009132462 A1 11/2009

OTHER PUBLICATIONS

Foreign communication from a related counterpart application—International Search Report and Written Opinion, PCT/GB2010/001524, Apr. 13, 2011, 11 pages.

Patent application entitled "A Method for individually servicing a plurality of zones of a subterranean formation," by Matthew Todd Howell, filed Feb. 10, 2011 as U.S. Appl. No. 13/025,039.

Patent application entitled "System and method for servicing a wellbore," by Jesse Cale Porter, et al., filed Feb. 10, 2011 as U.S. Appl. No. 13/025,041.
Patent application entitled "System and method for servicing a wellbore," by Jesse Cale Porter, et al., filed Jun. 2, 2011 as U.S. Appl. No. 13/151,457.
Office Action dated Jun. 24, 2010 (13 pages), U.S. Appl. No. 12/139,604, filed Jun. 16, 2008.
The Lee Company brochure entitled "Meet the EFS family," http://www.theleeco.com/EFSWEB2.NSF/Products!OpenPage, Apr. 21, 2009, 1 page.
The Lee Company brochure entitled "Meet the precision microhydraulics family," http.//222.theleeco.com/LEEWEB2.NSF/AeroStart!OpenPage, Apr. 21, 2009, 2 pages.
"Lohm calculator for gas flow," http://www.theleeco.com/EFSWEB2.NSF/airlohms.htm, Apr. 21, 2009, 2 pages, courtesy of The Lee Company.
"Lohm calculator for liquid flow," http://www.theleeco.com/EFSWEB2.NSF/flowcalc.htm, Apr. 21, 2009, 2 pages, courtesy of The Lee Company.
Patent application entitled "Method and apparatus for exposing a servicing apparatus to multiple formation zones," by Matthew Todd Howell, et al., filed Jun. 16, 2008 as U.S. Appl. No. 12/139,604.
Foreign communication from a related counterpart application—International Search Report and Written Opinion, PCT/GB2008/002646, Dec. 11, 2008, 8 pages.
Foreign communication from a related counterpart application—International Search Report and Written Opinion, PCT/GB2009/002693, Mar. 2, 2010, 8 pages.
Halliburton brochure entitled "RapidFrac™ System," Mar. 2011, 3 pages.
Packers Plus brochure entitled "Achieve immediate production; StackFRAC® HD," Mar. 11, 2011, 4 pages.
Foreign Communication from a related counterpart application—International Search Report and Written Opinion, PCT/GB2007/004628, Feb. 26, 2008, 8 pages.
Foreign Communication from a related counterpart application—International Search Report and Written Opinion, PCT/GB2009/001505, Feb. 8, 2011, 8 pages.
Halliburton brochure entitled "Delta Stim® Completion Service," Sep. 2008, 4 pages, Halliburton.
Halliburton brochure entitled "Delta Stim™ Sleeve," HO4616, Mar. 2007, 2 pages, Halliburton.
Halliburton brochure entitled "sFrac™ Valve," Jun. 2010, 3 pages, Halliburton.
Halliburton brochure entitled "Swellpacker® cable system," Aug. 2008, 2 pages, Halliburton.
Halliburton Marketing Data Sheet, Sand Control, EquiFlow™ Inflow Control Devices, HO5600, Jan. 2008, pp. 1-2.
Office Action dated Feb. 18, 2009 (18 pages), U.S. Appl. No. 11/609,128, filed Dec. 11, 2006.
Office Action (Final) dated Sep. 15, 2009 (12 pages), U.S. Appl. No. 11/609,128, filed Dec. 11, 2006.
Office Action dated Mar. 31, 2011 (19 pages), U.S. Appl. No. 12/166,257, filed Jul. 1, 2008.
Office Action (Final) dated Aug. 12, 2011 (12 pages), U.S. Appl. No. 12/166,257, filed Jul. 1, 2008.
Patent application entitled "Responsively activated wellbore stimulation assemblies and methods of using the same," by Brock William Miller, filed Jun. 8, 2011 as U.S. Appl. No. 13/156,155.
Patent application entitled "System and method for servicing a wellbore," by Matthew James Merron, et al., filed Aug. 23, 2011 as U.S. Appl. No. 13/215,553.
Foreign communication from a related counterpart application—International Search Report and Written Opinion, PCT/GB2010/002090, Aug. 12, 2011, 11 pages.
Packers Plus brochure entitled "High Density Multi-Stage Fracturing System; StackFRAC® HD," Apr. 20, 2010, 2 pages.
Office Action dated Mar. 28, 2012 (39 pages), U.S. Appl. No. 12/617,405, filed Nov. 12, 2009.
Patent application entitled "Responsively activated wellbore stimulation assemblies and methods of using the same," by William Mark Norrid, et al., filed Sep. 29, 2011 as U.S. Appl. No. 13/248,145.
Patent application entitled "Delayed activation activatable stimulation assembly," by Matthew James Merron, filed Apr. 30, 2012 as U.S. Appl. No. 13/460,453.
Foreign communication from a related counterpart application—International Search Report and Written Opinion, PCT/GB2012/000140, May 30, 2012, 11 pages.

* cited by examiner

SYSTEM AND METHOD FOR SERVICING A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Subterranean formations that contain hydrocarbons are sometimes non-homogeneous in their composition along the length of wellbores that extend into such formations. It is sometimes desirable to treat and/or otherwise manage the formation and/or the wellbore differently in response to the differing formation composition. Some wellbore servicing systems and methods allow such treatment and some refer to such treatments as zonal isolation treatments. However, in some wellbore servicing systems and methods, while multiple tools for use in treating zones may be activated by a single obturator, such activation of one tool by the obturator may cause activation of additional tools more difficult. For example, a ball may be used to activate a plurality of stimulation tools, thereby allowing fluid communication between a flow bore of the tools with a space exterior to the tools. However, such fluid communication accomplished by activated tools may increase the working pressure required to subsequently activate additional tools. Accordingly, there exists a need for improved systems and method of treating multiple zones of a wellbore.

SUMMARY

Disclosed herein is a wellbore servicing system, comprising a first sleeve system, the first sleeve system comprising a first sliding sleeve at least partially carried within a first ported case, the first sleeve system being selectively restricted from movement relative to the first ported case by a first restrictor while the first restrictor is enabled, and a first delay system configured to selectively restrict movement of the first sliding sleeve relative to the ported case while the restrictor is disabled.

Also disclosed herein is a method of servicing a wellbore, comprising providing a first sleeve system in the wellbore, the first sleeve system being initially configured in an installation mode where fluid flow between a flow bore of the first sleeve system and a port of the first sleeve system is restricted, providing a second sleeve system in the wellbore and downhole of the first sleeve system, the second sleeve system being initially configured in an installation mode where fluid flow between a flow bore of the second sleeve system and a port of the second sleeve system is restricted, and passing an obturator through at least a portion of the first sleeve system, thereby unlocking a first restrictor of the first sleeve system and thereby commencing operation of the first sleeve system in a delayed mode. The method may further comprise passing the first obturator through at least a portion of the second sleeve system, thereby unlocking a second restrictor of the second sleeve system, wherein the unlocking of the second restrictor is accomplished prior to allowing fluid flow between the flow bore of the first sleeve system and the port of the first sleeve system. The method may comprise, after the first sleeve system has operated in the delayed mode for a predetermined period of time, allowing fluid flow between the flow bore of the first sleeve system and the port of the first sleeve system. The method may further comprise, subsequent the unlocking of the second restrictor, passing fluid from the first sleeve system into a subterranean formation. The method may further comprise maintaining a fluid pressure sufficient to maintain operation of the first sleeve system in the delayed mode at least until the second restrictor is unlocked. The method may further comprise, subsequent the unlocking of the second restrictor, reducing the fluid pressure to discontinue operating the first sleeve system in the delayed mode. The method may further comprise, subsequently reducing the fluid pressure, increasing the fluid pressure to pass fluid from the first sleeve system into a subterranean formation. The first sleeve system and the second sleeve system may be associated with a same zone of the wellbore.

Also disclosed herein is a method of operating a wellbore servicing system, comprising providing a first sleeve system in the wellbore, providing a second sleeve system in the wellbore and downhole of the first sleeve system, passing a first obturator through at least a portion of the first sleeve system, thereby unlocking a first restrictor of the first sleeve system and thereby commencing operation of the first sleeve system in a delayed mode, and passing the first obturator through at least a portion of the second sleeve system, thereby unlocking a second restrictor of the second sleeve system. The first shear pin may be sheared to unlock the first restrictor. The first expandable seat of the first sliding sleeve may be expanded to allow passage of the first obturator through the first sleeve system, wherein after the unlocking of the first restrictor, a first piston of the first sleeve system may be moved in an uphole direction relative to a first sliding sleeve of the first sleeve system. After the first piston moves in an uphole direction, the first piston may move downhole only after a sufficient reduction in fluid pressure within a central flowbore of the first sleeve system. During downhole movement of the first piston, teeth of a c-ring substantially captured between the first piston and the first sliding sleeve may engage teeth of the first sliding sleeve, thereby causing downhole movement of the first sliding sleeve. The method may further comprise metering a flow of fluid exiting a first fluid chamber of the first sleeve system during operation of the first sleeve system in the delayed mode. The first sleeve system and the second sleeve system may be associated with a same zone of the wellbore.

Further disclosed herein is a method of servicing a wellbore, comprising providing a first wellbore servicing tool and a second wellbore servicing tool in the wellbore and in association with a first zone, and performing an actuation action that enables fluid communication between the first zone and each of the first wellbore servicing tool and the second wellbore servicing tool, the actuation action being at least partially carried out in response to at least one of a fluid pressure and a fluid flow.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
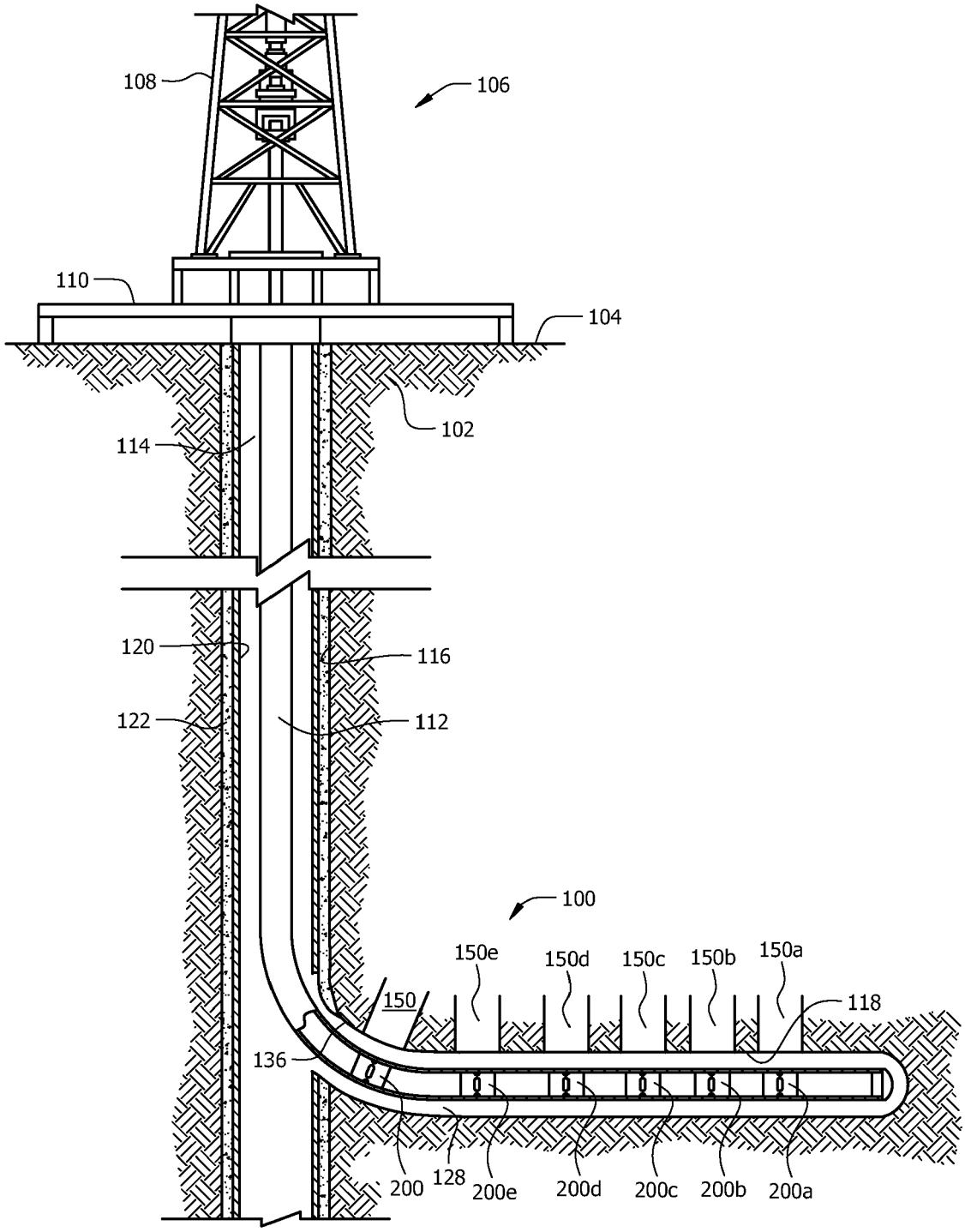
FIG. 1 is a cut-away view of an embodiment of a wellbore servicing system according to the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Some embodiments of the systems and methods of this disclosure provide sleeve systems that may be placed in a wellbore in a "run-in" configuration or an "installation mode" where a sleeve of the sleeve system blocks fluid transfer between a flow bore of the sleeve system and a port of the sleeve system. The installation mode may also be referred to as a "locked mode" since the sleeve is selectively locked in position relative to the port. In some embodiments, the locked positional relationship between the sleeves and the ports may be selectively discontinued or disabled by unlocking one or more components relative to each other, thereby potentially allowing movement of the sleeves relative to the ports. Still further, once the components are no longer locked in position relative to each other, some of the embodiments are configured to thereafter operate in a "delay mode" where relative movement between the sleeve and the port is delayed insofar as (1) such relative movement occurs but occurs at a reduced and/or controlled rate and/or (2) such relative movement is delayed until the occurrence of a selected wellbore condition. The delay mode may also be referred to as an "unlocked mode" since the sleeves are no longer locked in position relative to the ports. In some embodiments, the sleeve systems may be operated in the delay mode until the sleeve system achieves a "fully open mode" where the sleeve has moved relative to the port to allow maximum fluid communication between the flow bore of the sleeve system and the port of the sleeve system. It will be appreciated that devices, systems, and/or components of sleeve system embodiments that selectively contribute to establishing and/or maintaining the locked mode may be referred to as locking devices, locking systems, locks, movement restrictors, restrictors, and the like. It will also be appreciated that devices, systems, and/or components of sleeve system embodiments that selectively contribute to establishing and/or maintaining the delay mode may be referred to as delay devices, delay systems, delays, timers, contingent openers, and the like.

Generally, in some embodiments, the present disclosure further provides for configuring a plurality of such sleeve systems so that one or more sleeve systems may be selectively transitioned from the installation mode to the delay mode by passing a single obturator (or any other suitable actuator or actuating device) through the plurality of sleeve systems. As will be explained below in greater detail, in some embodiments, one or more sleeve systems may be configured to interact with an obturator of a first configuration while other sleeve systems may be configured not to interact with the obturator having the first configuration, but rather, configured to interact with an obturator having a second configuration. Such differences in configurations amongst the various sleeve systems may allow an operator to selectively transition some sleeve systems to the exclusion of other sleeve systems. The following discussion describes various embodiments of sleeve systems, the physical operation of the sleeve systems individually, and methods of servicing wellbores using such sleeve systems.

Referring to FIG. 1, an embodiment of a wellbore servicing system 100 is shown in an example of an operating environment. As depicted, the operating environment comprises a servicing rig 106 (e.g., a drilling, completion, or workover rig) that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved.

At least a portion of the vertical wellbore portion 116 is lined with a casing 120 that is secured into position against the subterranean formation 102 in a conventional manner using cement 122. In alternative operating environments, a horizontal wellbore portion may be cased and cemented and/or portions of the wellbore may be uncased. The servicing rig 106 comprises a derrick 108 with a rig floor 110 through which a tubing or work string 112 (e.g., cable, wireline, E-line, Z-line, jointed pipe, coiled tubing, casing, or liner string, etc.)

extends downward from the servicing rig 106 into the wellbore 114 and defines an annulus 128 between the work string 112 and the wellbore 114. The work string 112 delivers the wellbore servicing system 100 to a selected depth within the wellbore 114 to perform an operation such as perforating the casing 120 and/or subterranean formation 102, creating perforation tunnels and/or fractures (e.g., dominant fractures, micro-fractures, etc.) within the subterranean formation 102, producing hydrocarbons from the subterranean formation 102, and/or other completion operations. The servicing rig 106 comprises a motor driven winch and other associated equipment for extending the work string 112 into the wellbore 114 to position the wellbore servicing system 100 at the selected depth.

While the operating environment depicted in FIG. 1 refers to a stationary servicing rig 106 for lowering and setting the wellbore servicing system 100 within a land-based wellbore 114, in alternative embodiments, mobile workover rigs, wellbore servicing units (such as coiled tubing units), and the like may be used to lower a wellbore servicing system into a wellbore. It should be understood that a wellbore servicing system may alternatively be used in other operational environments, such as within an offshore wellbore operational environment.

The subterranean formation 102 comprises a deviated zone 150 associated with deviated wellbore portion 136. The subterranean formation 102 further comprises first, second, third, fourth, and fifth horizontal zones, 150*a*, 150*b*, 150*c*, 150*d*, 150*e*, respectively, associated with the horizontal wellbore portion 118. In this embodiment, the zones 150, 150*a*, 150*b*, 150*c*, 150*d*, 150*e* are offset from each other along the length of the wellbore 114 in the following order of increasingly downhole location: 150, 150*e*, 150*d*, 150*c*, 150*b*, and 150*a*. In this embodiment, stimulation and production sleeve systems 200, 200*a*, 200*b*, 200*c*, 200*d*, and 200*e* are located within wellbore 114 in the work string 112 and are associated with zones 150, 150*a*, 150*b*, 150*c*, 150*d*, and 150*e*, respectively. It will be appreciated that zone isolation devices such as annular isolation devices (e.g., annular packers and/or swellpackers) may be selectively disposed within wellbore 114 in a manner that restricts fluid communication between spaces immediately uphole and downhole of each annular isolation device.

Figure 2:
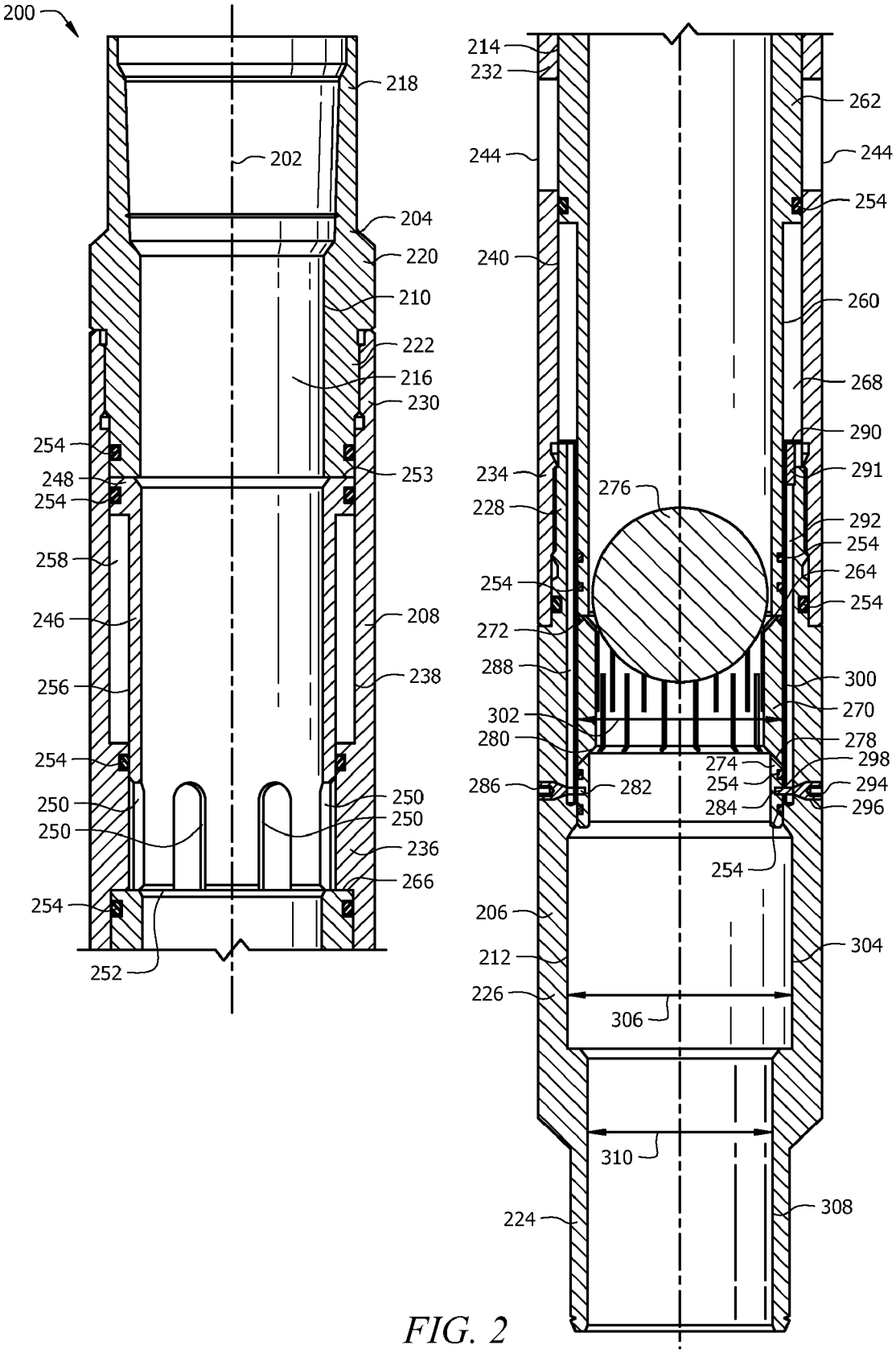
FIG. 2 is a cross-sectional view of a sleeve system of the wellbore servicing system of FIG. 1 showing the sleeve system in an installation mode.

Referring now to FIG. 2, a cross-sectional view of an embodiment of a stimulation and production sleeve system 200 (hereinafter referred to as "sleeve system" 200) is shown. Many of the components of sleeve system 200 lie substantially coaxial with a central axis 202 of sleeve system 200. Sleeve system 200 comprises an upper adapter 204, a lower adapter 206, and a ported case 208. The ported case 208 is joined between the upper adapter 204 and the lower adapter 206. Together, inner surfaces 210, 212, 214 of the upper adapter 204, the lower adapter 206, and the ported case 208, respectively, substantially define a sleeve flow bore 216. The upper adapter 204 comprises a collar 218, a makeup portion 220, and a case interface 222. The collar 218 is internally threaded and otherwise configured for attachment to an element of work string 112 that is adjacent and uphole of sleeve system 200 while the case interface 222 comprises external threads for engaging the ported case 208. The lower adapter 206 comprises a nipple 224, a makeup portion 226, and a case interface 228. The nipple 224 is externally threaded and otherwise configured for attachment to an element of work string 112 that is adjacent and downhole of sleeve system 200 while the case interface 228 also comprises external threads for engaging the ported case 208.

The ported case 208 is substantially tubular in shape and comprises an upper adapter interface 230, a central ported body 232, and a lower adapter interface 234, each having substantially the same exterior diameters. The inner surface 214 of ported case 208 comprises a case shoulder 236 that separates an upper inner surface 238 from a lower inner surface 240. The ported case 208 further comprises ports 244. As will be explained in further detail below, ports 244 are through holes extending radially through the ported case 208 and are selectively used to provide fluid communication between sleeve flow bore 216 and a space immediately exterior to the ported case 208.

The sleeve system 200 further comprises a piston 246 carried within the ported case 208. The piston 246 is substantially configured as a tube comprising an upper seal shoulder 248 and a plurality of slots 250 near a lower end 252 of the piston 246. With the exception of upper seal shoulder 248, the piston 246 comprises an outer diameter smaller than the diameter of the upper inner surface 238. The upper seal shoulder 248 carries a circumferential seal 254 that provides a fluid tight seal between the upper seal shoulder 248 and the upper inner surface 238. Further, case shoulder 236 carries a seal 254 that provides a fluid tight seal between the case shoulder 236 and an outer surface 256 of piston 246. In the embodiment shown and when the sleeve system 200 is configured in an installation mode, the upper seal shoulder 248 of the piston 246 abuts the upper adapter 204. The piston 246 extends from the upper seal shoulder 248 toward the lower adapter 206 so that the slots 250 are located downhole of the seal 254 carried by case shoulder 236. In this embodiment, the portion of the piston 246 between the seal 254 carried by case shoulder 236 and the seal 254 carried by the upper seal shoulder 248 comprises no apertures in the tubular wall (i.e., is a solid, fluid tight wall). As shown in this embodiment and in the installation mode of FIG. 2, a low pressure chamber 258 is located between the outer surface 256 of piston 246 and the upper inner surface 238 of the ported case 208.

The sleeve system 200 further comprises a sleeve 260 carried within the ported case 208 below the piston 246. The sleeve 260 is substantially configured as a tube comprising an upper seal shoulder 262. With the exception of upper seal shoulder 262, the sleeve 260 comprises an outer diameter substantially smaller than the diameter of the lower inner surface 240. The upper seal shoulder 262 carries two circumferential seals 254, one seal 254 near each end (e.g., upper and lower ends) of the upper seal shoulder 262, that provide fluid tight seals between the upper seal shoulder 262 and the lower inner surface 240 of ported case 208. Further, two seals 254 are carried by the sleeve 260 near a lower end 264 of sleeve 260, and the two seals 254 form fluid tight seals between the sleeve 260 and the inner surface 212 of the lower adapter 206. In this embodiment and installation mode shown in FIG. 2, an upper end 266 of sleeve 260 substantially abuts a lower end of the case shoulder 236 and the lower end 252 of piston 246. In this embodiment and installation mode shown in FIG. 2, the upper seal shoulder 262 of the sleeve 260 seals ports 244 from fluid communication with the sleeve flow bore 216. Further, the seal 254 carried near the lower end of the upper seal shoulder 262 is located downhole of (e.g., below) ports 244 while the seal 254 carried near the upper end of the upper seal shoulder 262 is located uphole of (e.g., above) ports 244. The portion of the sleeve 260 between the seal 254 carried near the lower end of the upper seal shoulder 262 and the seals 254 carried by the sleeve 260 near a lower end 264 of sleeve 260 comprises no apertures in the tubular wall (i.e., is a solid, fluid tight wall). As shown in this embodiment and in the installation mode of FIG. 2, a fluid chamber 268 is located between the outer surface of sleeve 260 and the lower inner surface 240 of the ported case 208.

The sleeve system 200 further comprises an expandable seat 270 carried within the lower adapter 206 below the sleeve 260. In this embodiment and installation mode shown in FIG. 2, the expandable seat 270 may be constructed of, for example but not limited to, a low alloy steel such as AISI 4140 or 4130, and is generally configured to be biased radially outward so that if unrestricted radially, a diameter (e.g., outer/inner) of the seat 270 increases. In some embodiments, the expandable seat 270 may be constructed from a generally serpentine length of AISI 4140. For example, the expandable seat may comprise a plurality of serpentine loops between upper and lower portions of the seat and continuing circumferentially to form the seat. The seat 270 further comprises a seat gasket 272 that serves to seal against an obturator 276. In some embodiments, the seat gasket 272 may be constructed of rubber. It will be appreciated that while obturator 276 is shown in FIG. 2 with the sleeve system 200 in an installation mode, in most applications of the sleeve system 200, the sleeve system 200 would be placed downhole without the obturator 276, and the obturator 276 would subsequently be provided as discussed below in greater detail. Further, while the obturator 276 is a ball, an obturator of other embodiments may be any other suitable shape or device for sealing against the seat gasket 272 and obstructing flow through the sleeve flow bore 216. In this embodiment and installation mode shown in FIG. 2, the seat gasket 272 is substantially captured between the expandable seat 270 and the lower end 264 of sleeve 260.

The sleeve system 200 further comprises a seat support 274 carried within the lower adapter 206 below the seat 270. The seat support 274 is substantially formed as a tubular member. The seat support 274 comprises an outer chamfer 278 on the upper end of the seat support 274 that selectively engages an inner chamfer 280 on the lower end of the expandable seat 270. The seat support 274 comprises a circumferential channel 282. The seat support 274 further comprises two seals 254, one seal 254 carried uphole of (e.g., above) the channel 282 and the other seal 254 carried downhole of (e.g., below) the channel 282, and the seals 254 form a fluid seal between the seat support 274 and the inner surface 212 of the lower adapter 206. In this embodiment and installation mode shown in FIG. 2, the seat support 274 is restricted from downhole movement by a shear pin 284 that extends from the lower adapter 206 and is received within the channel 282. Accordingly, each of the seat 270, seat gasket 272, sleeve 260, and piston 246 are captured between the seat support 274 and the upper adapter 204 due to the restriction of movement of the seat support 274.

The lower adapter 206 further comprises a fill port 286, a fill bore 288, a metering device receptacle 290, a drain bore 292, and a plug 294. In this embodiment, the fill port 286 comprises a check valve device housed within a radial through bore formed in the lower adapter 206 that joins the fill bore 288 to a space exterior to the lower adapter 206. The fill bore 288 is formed as a substantially cylindrical longitudinal bore that lies substantially parallel to the central axis 202. The fill bore 288 joins the fill port 286 in fluid communication with the fluid chamber 268. Similarly, the metering device receptacle 290 is formed as a substantially cylindrical longitudinal bore that lies substantially parallel to the central axis 202. The metering device receptacle 290 joins the fluid chamber 268 in fluid communication with the drain bore 292. Further, drain bore 292 is formed as a substantially cylindrical longitudinal bore that lies substantially parallel to the central axis 202. The drain bore 292 extends from the metering device receptacle 290 to each of a plug bore 296 and a shear pin bore 298. In this embodiment, the plug bore 296 is a radial through bore formed in the lower adapter 206 that joins the drain bore 292 to a space exterior to the lower adapter 206. The shear pin bore 298 is a radial through bore formed in the lower adapter 206 that joins the drain bore 292 to sleeve flow bore 216. However, in the installation mode shown in FIG. 2, fluid communication between the drain bore 292 and the flow bore 216 is obstructed by seat support 274, seals 254, and shear pin 284.

The sleeve system 200 further comprises a fluid metering device 291 received at least partially within the metering device receptacle 290. In this embodiment, the fluid metering device 291 is fluid restrictor, for example a precision micro-hydraulics fluid restrictor or micro-dispensing valve of the type produced by The Lee Company of Westbrook, Conn. However, it will be appreciated that in alternative embodiments any other suitable fluid metering device may be used. For example, any suitable electro-fluid device may be used to selectively pump and/or restrict passage of fluid through the device. In further alternative embodiments, a fluid metering device may be selectively controlled by an operator and/or computer so that passage of fluid through the metering device may be started, stopped, and/or a rate of fluid flow through the device may be changed. Such controllable fluid metering devices may be, for example, substantially similar to the fluid restrictors produced by The Lee Company.

The lower adapter 206 may be described as comprising an upper central bore 300 having an upper central bore diameter 302, the seat catch bore 304 having a seat catch bore diameter 306, and a lower central bore 308 having a lower central bore diameter 310. The upper central bore 300 is joined to the lower central bore 308 by the seat catch bore 304. In this embodiment, the upper central bore diameter 302 is sized to closely fit an exterior of the seat support 274, and in an embodiment is about equal to the diameter of the outer surface of the sleeve 260. However, the seat catch bore diameter 306 is substantially larger than the upper central bore diameter 302, thereby allowing radial expansion of the expandable seat 270 when the expandable seat 270 enters the seat catch bore 304 as described in greater detail below. In this embodiment, the lower central bore diameter 310 is smaller than each of the upper central bore diameter 302 and the seat catch bore diameter 306, and in an embodiment is about equal to the diameter of the inner surface of the sleeve 260. Accordingly, as described in greater detail below, while the seat support 274 closely fits within the upper central bore 300 and loosely fits within the seat catch bore diameter 306, the seat support 274 is too large to fit within the lower central bore 308.

Figure 3:
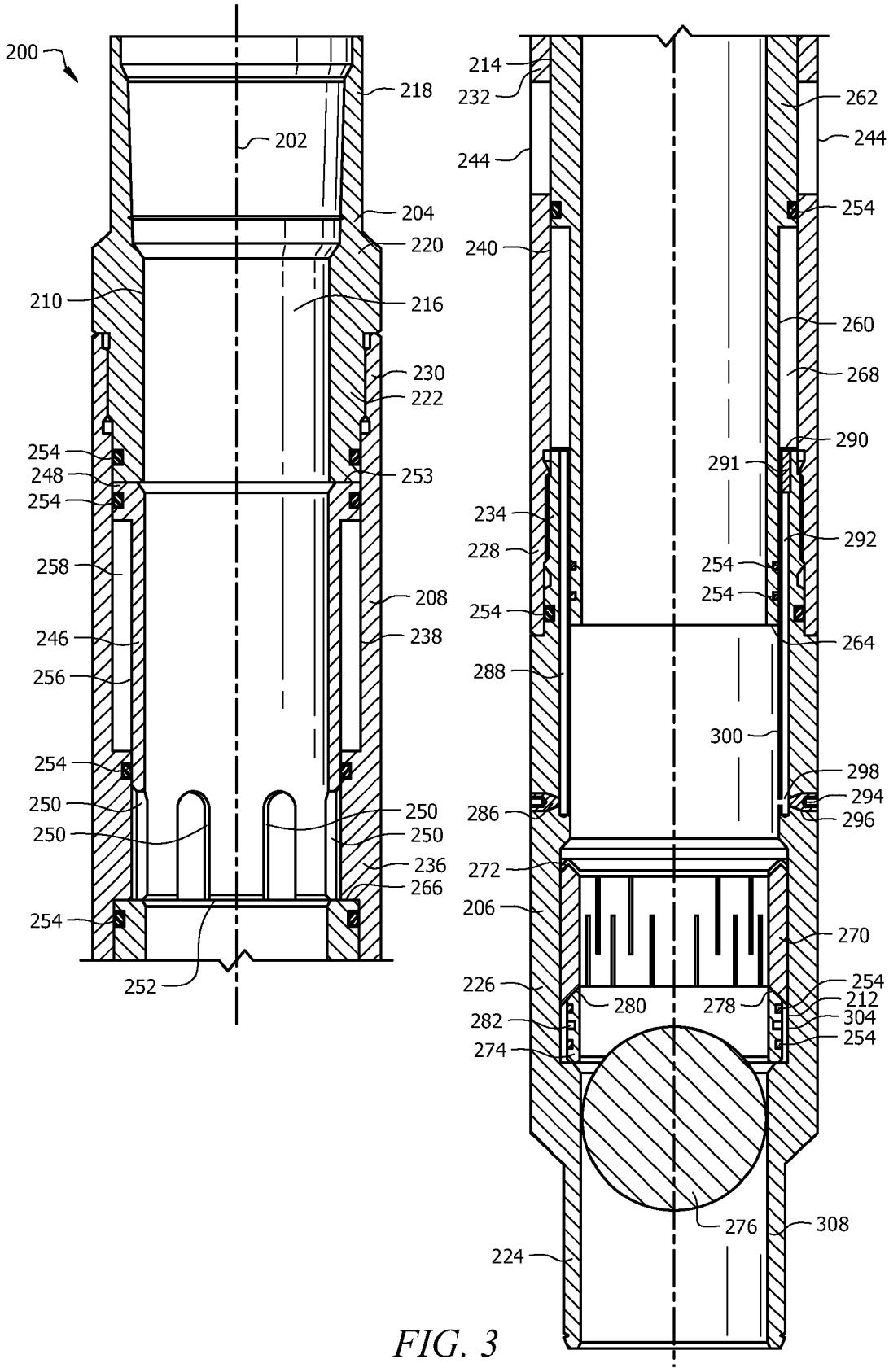
FIG. 3 is a cross-sectional view of the sleeve system of FIG. 2 showing the sleeve system in a delay mode.
Figure 4:
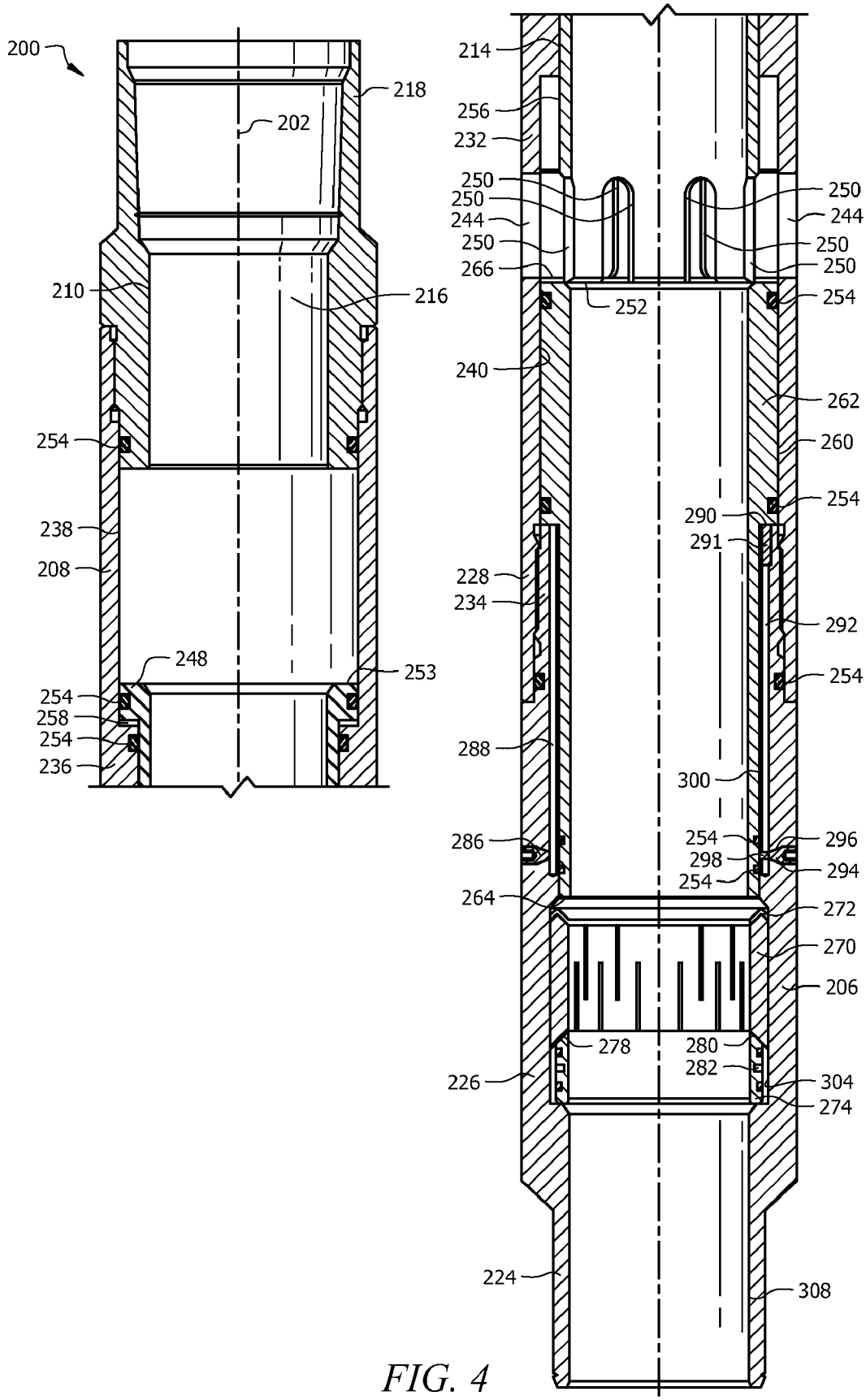
FIG. 4 is a cross-sectional view of the sleeve system of FIG. 2 showing the sleeve system in a fully open mode.

Referring now to FIGS. 2-4, a method of operating the sleeve system 200 is described below. Most generally, FIG. 2 shows the sleeve system 200 in an "installation mode" where sleeve 260 is restricted from moving relative to the ported case 208 by the shear pin 284. FIG. 3 shows the sleeve system 200 in a "delay mode" where sleeve 260 is no longer restricted from moving relative to the ported case 208 by the shear pin 284 but remains restricted from such movement due to the presence of a fluid within the fluid chamber 268. Finally, FIG. 4 shows the sleeve system 200 in a "fully open mode" where sleeve 260 no longer obstructs a fluid path between ports 244 and sleeve flow bore 216, but rather, a fluid path is provided between ports 244 and the sleeve flow bore 216 through slots 250 of the piston 246.

Referring now to FIG. 2, while the sleeve system 200 is in the installation mode, each of the piston 246, sleeve 260, seat gasket 272, seat 270, and seat support 274 are all restricted from movement along the central axis 202 at least because the shear pin 284 is received within both the shear pin bore 298 of the lower adapter 206 and within the circumferential channel 282 of the seat support 274. Also in this installation mode, low pressure chamber 258 is provided a volume of compressible fluid at atmospheric pressure. It will be appreciated that the fluid within the low pressure chamber 258 may be air, gaseous nitrogen, or any other suitable compressible fluid. Because the fluid within the low pressure chamber 258 is at atmospheric pressure, when sleeve system 200 is located downhole the fluid pressure within the sleeve flow bore 216 is substantially greater than the pressure within the low pressure chamber 258. Such a pressure differential may be attributed in part due to the weight of the fluid column within the sleeve flow bore 216, and in some circumstances, also due to increased pressures within the sleeve flow bore 216 caused by pressurizing the sleeve flow bore 216 using pumps. Further, a fluid is provided within the fluid chamber 268. Generally, the fluid may be introduced into the fluid chamber 268 through the fill port 286 and subsequently through the fill bore 288. During such filling of the fluid chamber 268, one or more of the shear pin 284 and the plug 294 may be removed to allow egress of other fluids or excess of the filling fluid. Thereafter, the shear pin 284 and/or the plug 294 may be replaced to capture the fluid within the fill bore 288, fluid chamber 268, the metering device 291, and the drain bore 292. With the sleeve system 200 and installation mode described above, though the sleeve flow bore 216 may be pressurized, movement of the above-described restricted portions of the sleeve system 200 remains restricted.

Referring now to FIG. 3, the obturator 276 may be passed through the work string 112 until the obturator 276 substantially seals against the seat gasket 272 (as shown in FIG. 2). With the obturator 276 in place against the seat gasket 272, the pressure within the sleeve flow bore 216 may be increased uphole of the obturator until the obturator 276 transmits sufficient force through the seat gasket 272, the seat 270, and the seat support 274 to cause the shear pin 284 to shear. Once the shear pin 284 has sheared, the obturator 276 drives the seat gasket 272, the seat 270, and the seat support 274 downhole from their installation mode positions. However, even though the sleeve 260 is no longer restricted from downhole movement by the seat gasket 272 and the seat 270, downhole movement of the sleeve 260 and the piston 246 above the sleeve 260 is delayed. Once the seat gasket 272 no longer obstructs downward movement of the sleeve 260, the sleeve system 200 may be referred to as being in a "delayed mode."

More specifically, downhole movement of the sleeve 260 and the piston 246 are delayed by the presence of fluid within fluid chamber 268. With the sleeve system 200 in the delay mode, the relatively low pressure within the low pressure chamber 258 in combination with relatively high pressures within the sleeve flow bore 216 acting on the upper end 253 of the piston 246, the piston 246 is biased in a downhole direction. However, downhole movement of the piston 246 is obstructed by the sleeve 260. Nonetheless, downhole movement of the obturator 276, the seat gasket 272, the seat 270, and the seat support 274 are not restricted or delayed by the presence of fluid within fluid chamber 268. Instead, the seat gasket 272, the seat 270, and the seat support 274 move downhole into the seat catch bore 304 of the lower adapter 206. While within the seat catch bore 304, expandable seat 270 expands radially to substantially match the seat catch bore diameter 306. The seat support 274 is subsequently captured between the expanded seat 270 and substantially at an interface (e.g., a shoulder formed) between the seat catch bore 304 and the lower central bore 308. For example, the outer diameter of seat support 274 is greater than the lower central bore diameter 310. Once the seat 270 expands sufficiently, the obturator 276 is free to pass through the expanded seat 270, through the seat support 274, and into the lower central bore 308. As will be explained below in greater detail, the obturator 276 is then free to exit the sleeve system 200 and flow further downhole to interact with additional sleeve systems.

Even after the exiting of the obturator 276 from sleeve system 200, downhole movement of the sleeve 260 occurs at a rate dependent upon the rate at which fluid is allowed to escape the fluid chamber 268 through the fluid metering device 291. It will be appreciated that fluid may escape the fluid chamber 268 by passing from the fluid chamber 268 through the fluid metering device 291, through the drain bore 292, through the shear pin bore 298 around the remnants of the sheared shear pin 284, and into the sleeve flow bore 216. As the volume of fluid within the fluid chamber 268 decreases, the sleeve 260 moves in a downhole direction until the upper seal shoulder 262 of the sleeve 260 contacts the lower adapter 206 near the metering device receptacle 290. It will be appreciated that shear pins or screws with central bores that provide a convenient fluid path may be used in place of shear pin 284.

Referring now to FIG. 4, when substantially all of the fluid within fluid chamber 268 has escaped, sleeve system 200 is in a "fully open mode." In the fully open mode, upper seal shoulder 262 of sleeve 260 contacts lower adapter 206 so that the fluid chamber 268 is substantially eliminated. Similarly, in a fully open mode, the upper seal shoulder 248 of the piston 246 is located substantially further downhole and has compressed the fluid within low pressure chamber 258 so that the upper seal shoulder 248 is substantially closer to the case shoulder 236 of the ported case 208. With the piston 246 in this position, the slots 250 are substantially aligned with ports 244 thereby providing fluid communication between the sleeve flow bore 216 and the ports 244. It will be appreciated that the sleeve system 200 is configured in various "partially opened modes" when movement of the components of sleeve system 200 provides fluid communication between sleeve flow bore 216 and the ports 244 to a degree less than that of the "fully open mode." It will further be appreciated that with any degree of fluid communication between the sleeve flow bore 216 and the ports 244, fluids may be forced out of the sleeve system 200 through the ports 244, or alternatively, fluids may be passed into the sleeve system 200 through the ports 244.

Figure 5:
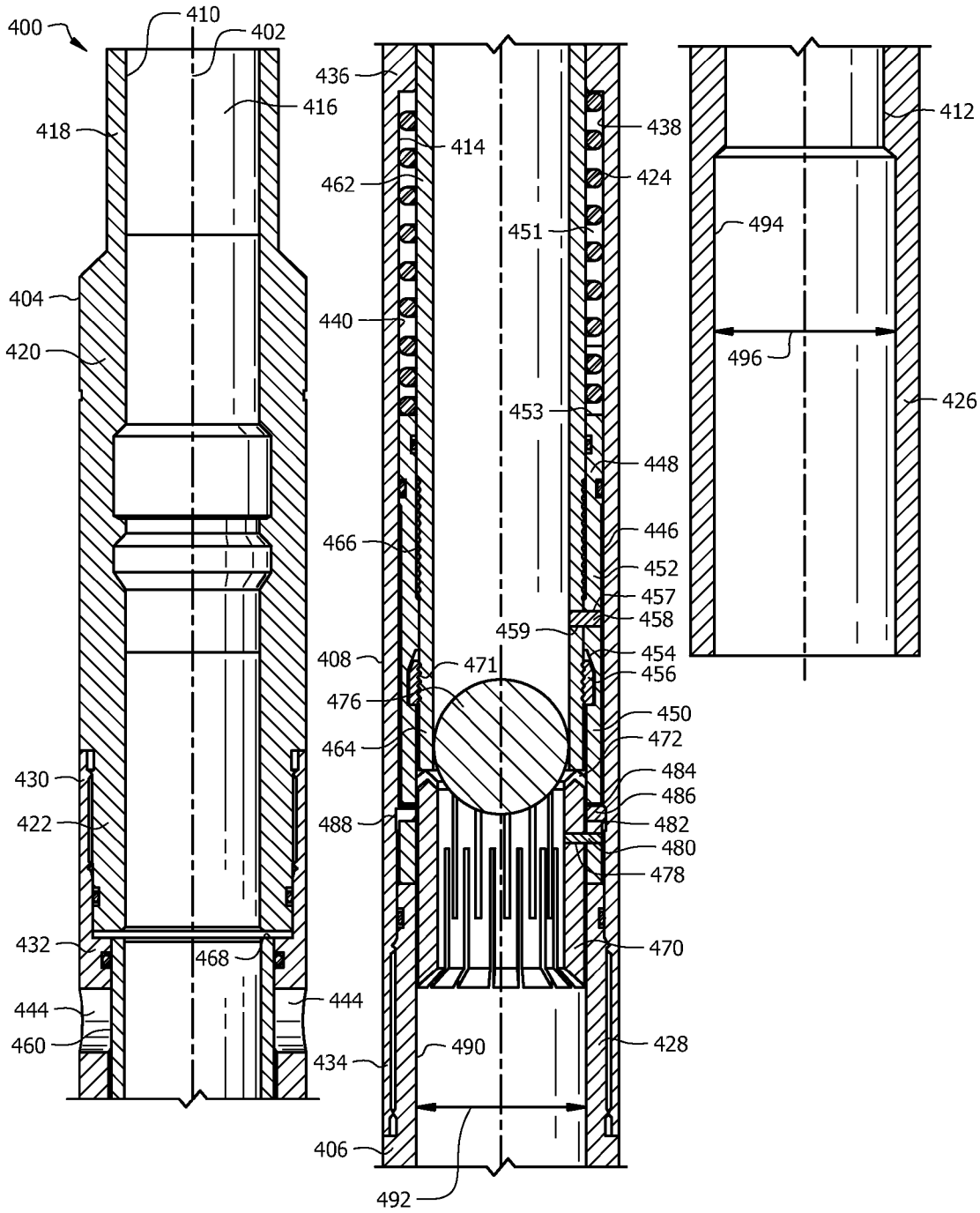
FIG. 5 is a cross-sectional view of an alternative embodiment of a sleeve system according to the disclosure showing the sleeve system in an installation mode.

Referring now to FIG. 5, a cross-sectional view of an alternative embodiment of a stimulation and production sleeve system 400 (hereinafter referred to as "sleeve system" 400) is shown. Many of the components of sleeve system 400 lie substantially coaxial with a central axis 402 of sleeve system 400. Sleeve system 400 comprises an upper adapter 404, a lower adapter 406, and a ported case 408. The ported case 408 is joined between the upper adapter 404 and the lower adapter 406. Together, inner surfaces 410, 412 of the upper adapter 404 and the lower adapter 406, respectively, and the inner surface of the ported case 408 substantially define a sleeve flow bore 416. The upper adapter 404 comprises a collar 418, a makeup portion 420, and a case interface 422. The collar 418 is internally threaded and otherwise configured for attachment to an element of a work string, such as for example, work string 112, that is adjacent and uphole of sleeve system 400 while the case interface 422 comprises external threads for engaging the ported case 408. The lower adapter 406 comprises a makeup portion 426 and a case interface 428. The lower adapter 406 is configured (e.g., threaded) for attachment to an element of a work string that is adjacent and downhole of sleeve system 400 while the case interface 428 comprises external threads for engaging the ported case 408.

The ported case 408 is substantially tubular in shape and comprises an upper adapter interface 430, a central ported body 432, and a lower adapter interface 434, each having substantially the same exterior diameters. The inner surface 414 of ported case 408 comprises a case shoulder 436 between an upper inner surface 438 and ports 444. A lower inner surface 440 is adjacent and below the upper inner surface 438, and the lower inner surface 440 comprises a smaller diameter than the upper inner surface 438. As will be explained in further detail below, ports 444 are through holes extending radially through the ported case 408 and are selectively used to provide fluid communication between sleeve flow bore 416 and a space immediately exterior to the ported case 408.

The sleeve system 400 further comprises a sleeve 460 carried within the ported case 408 below the upper adapter 404. The sleeve 460 is substantially configured as a tube comprising an upper section 462 and a lower section 464. The lower section 464 comprises a smaller outer diameter than the upper section 462. The lower section 464 comprises circumferential ridges or teeth 466. In this embodiment and installation mode shown in FIG. 5, an upper end 468 of sleeve 460 substantially abuts the upper adapter 404 and extends downward therefrom, thereby blocking fluid communication between the ports 444 and the sleeve flow bore 416.

The sleeve system 400 further comprises a piston 446 carried within the ported case 408. The piston 446 is substantially configured as a tube comprising an upper portion 448 joined to a lower portion 450 by a central body 452. In the installation mode, the piston 446 abuts the lower adapter 406. Together, an upper end 453 of piston 446, upper sleeve section 462, the upper inner surface 438, the lower inner surface 440, and the lower end of case shoulder 436 form a bias chamber 451. In this embodiment, a compressible spring 424 is received within the bias chamber 451 and the spring 424 is generally wrapped around the sleeve 460. The piston 446 further comprises a c-ring channel 454 for receiving a c-ring 456 therein. The piston also comprises a shear pin receptacle 457 for receiving a shear pin 458 therein. The shear pin 458 extends from the shear pin receptacle 457 into a similar shear pin aperture 459 that is formed in the sleeve 460. Accordingly, in the installation mode shown in FIG. 5, the piston 446 is restricted from moving relative to the sleeve 460 by the shear pin 458. It will be appreciated that the c-ring 456 comprises ridges or teeth 471 that complement the teeth 466 in a manner that allows sliding of the c-ring 456 upward relative to the sleeve 460 but not downward while the sets of teeth 466, 471 are engaged with each other.

The sleeve system 400 further comprises an expandable seat 470, similar to seat 270 described previously, carried within a lower portion of the piston 446 and within an upper portion of the lower adapter 406. In this embodiment and installation mode shown in FIG. 5, the expandable seat 470 is generally constructed of, for example but not limited to, a low alloy steel such as AISI 4140 or 4130 and is generally configured to be biased radially outward so that if unrestricted radially, a diameter (e.g., outer/inner) of the seat 470 increases. In this embodiment, the expandable seat 470 is constructed from a generally serpentine length of AISI 4140. The seat 470 further comprises a seat gasket 472 that serves to seal against an obturator 476. In some embodiments, the seat gasket 472 may be constructed of rubber. It will be appreciated that while obturator 476 is shown in FIG. 5 with the sleeve system 400 in an installation mode, in most applications of the sleeve system 400, the sleeve system 400 would be placed downhole without the obturator 476 and the obturator 476 would subsequently be provided as discussed below in greater detail. Further, while the obturator 476 is a ball, an obturator of other embodiments may be any other suitable shape or device for sealing against the seat gasket 472 and obstructing flow through the sleeve flow bore 416. In this embodiment and installation mode shown in FIG. 5, the seat gasket 472 is substantially captured between the expandable seat 470 and the lower end 464 of sleeve 460.

The seat 470 further comprises a seat shear pin aperture 478 that is radially aligned with and substantially coaxial with a similar piston shear pin aperture 480 formed in the piston 446. Together, the apertures 478, 480 receive a shear pin 482, thereby restricting movement of the seat 470 relative to the piston 446. Further, the piston 446 comprises a lug receptacle 484 for receiving a lug 486. In the installation mode of the sleeve system 400, the lug 486 is captured within the lug receptacle 484 between the seat 470 and the ported case 408. More specifically, the lug 486 extends into a substantially circumferential lug channel 488 formed in the ported case 408, thereby restricting movement of the piston 446 relative to the ported case 408. Accordingly, in the installation mode, with each of the shear pins 458, 482 and the lug 486 in place as described above, the piston 446, sleeve 460, and seat 470 are all substantially locked into position relative to the ported case 408 and relative to each other so that fluid communication between the sleeve flow bore 416 and the ports 444 is prevented.

The lower adapter 406 may be described as comprising an upper central bore 490 having an upper central bore diameter 492 and a seat catch bore 494 having a seat catch bore diameter 496 joined to the upper central bore 490. In this embodiment, the upper central bore diameter 492 is sized to closely fit an exterior of the seat 470, and in an embodiment is about equal to the diameter of the outer surface of the lower sleeve section 464. However, the seat catch bore diameter 496 is substantially larger than the upper central bore diameter 492, thereby allowing radial expansion of the expandable seat 470 when the expandable seat 470 enters the seat catch bore 494 as described in greater detail below.

Figure 6:
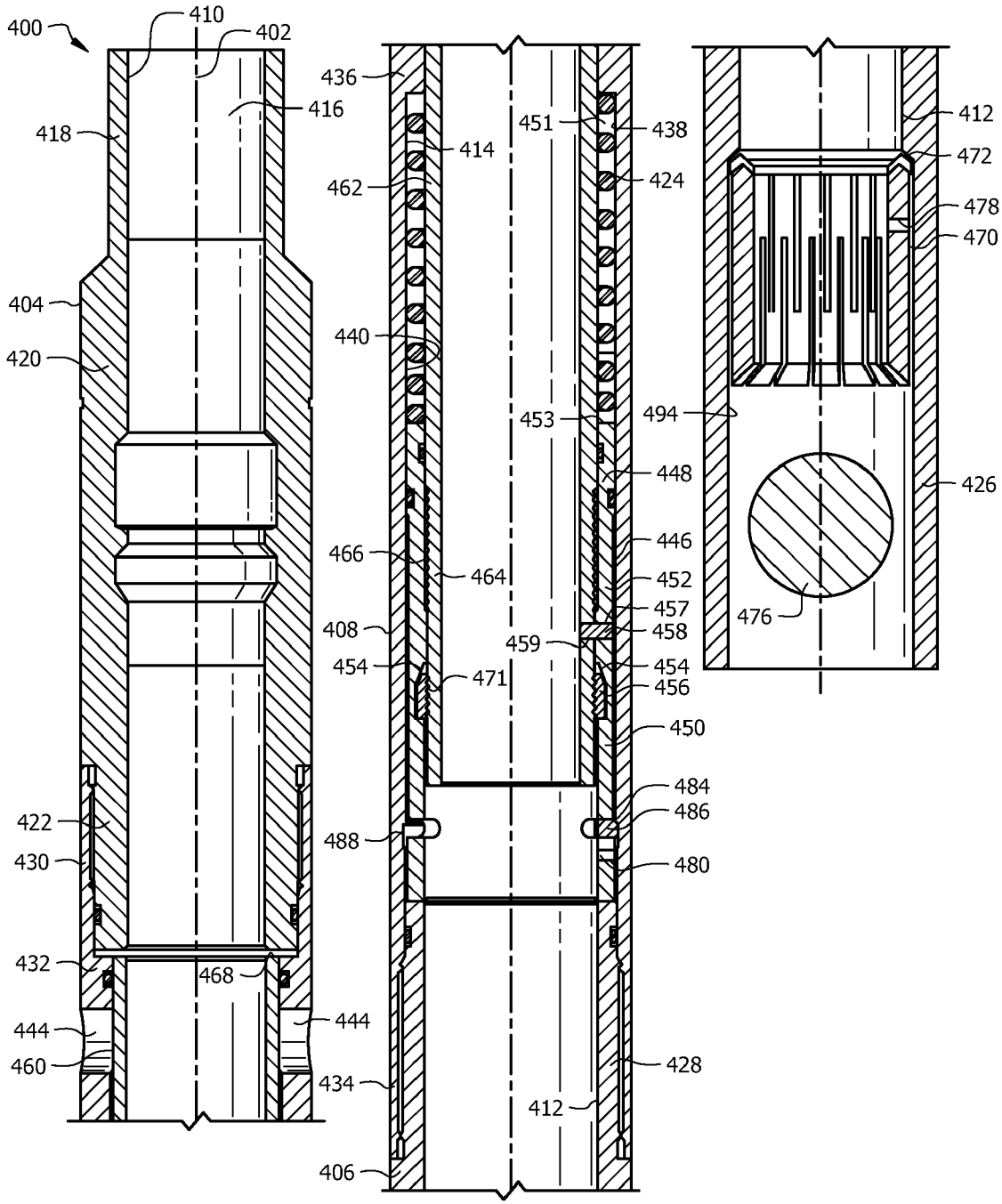
FIG. 6 is a cross-sectional view of the sleeve system of FIG. 5 showing the sleeve system in another stage of the installation mode.
Figure 7:
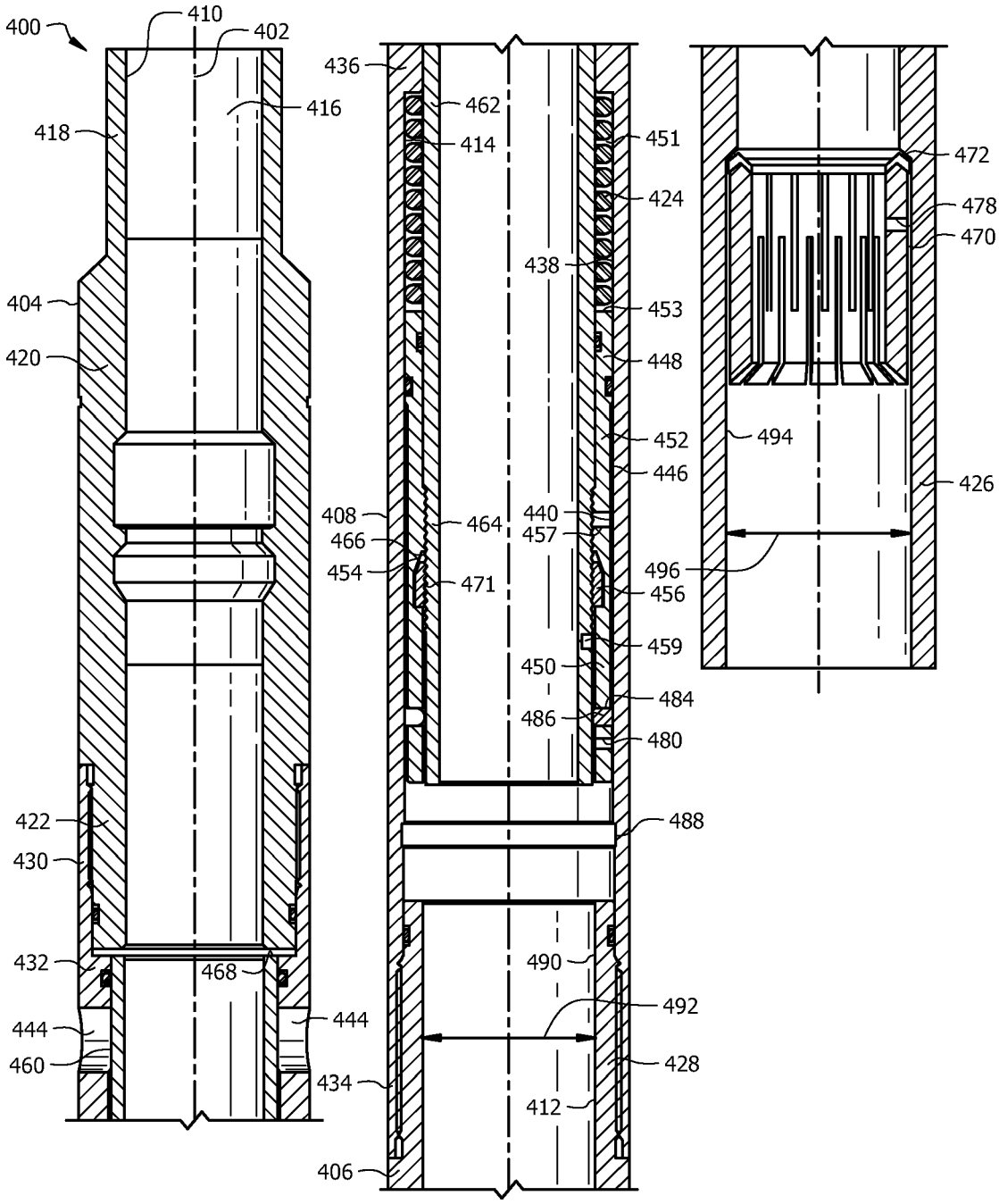
FIG. 7 is a cross-sectional view of the sleeve system of FIG. 5 showing the sleeve system in a delay mode.
Figure 8:
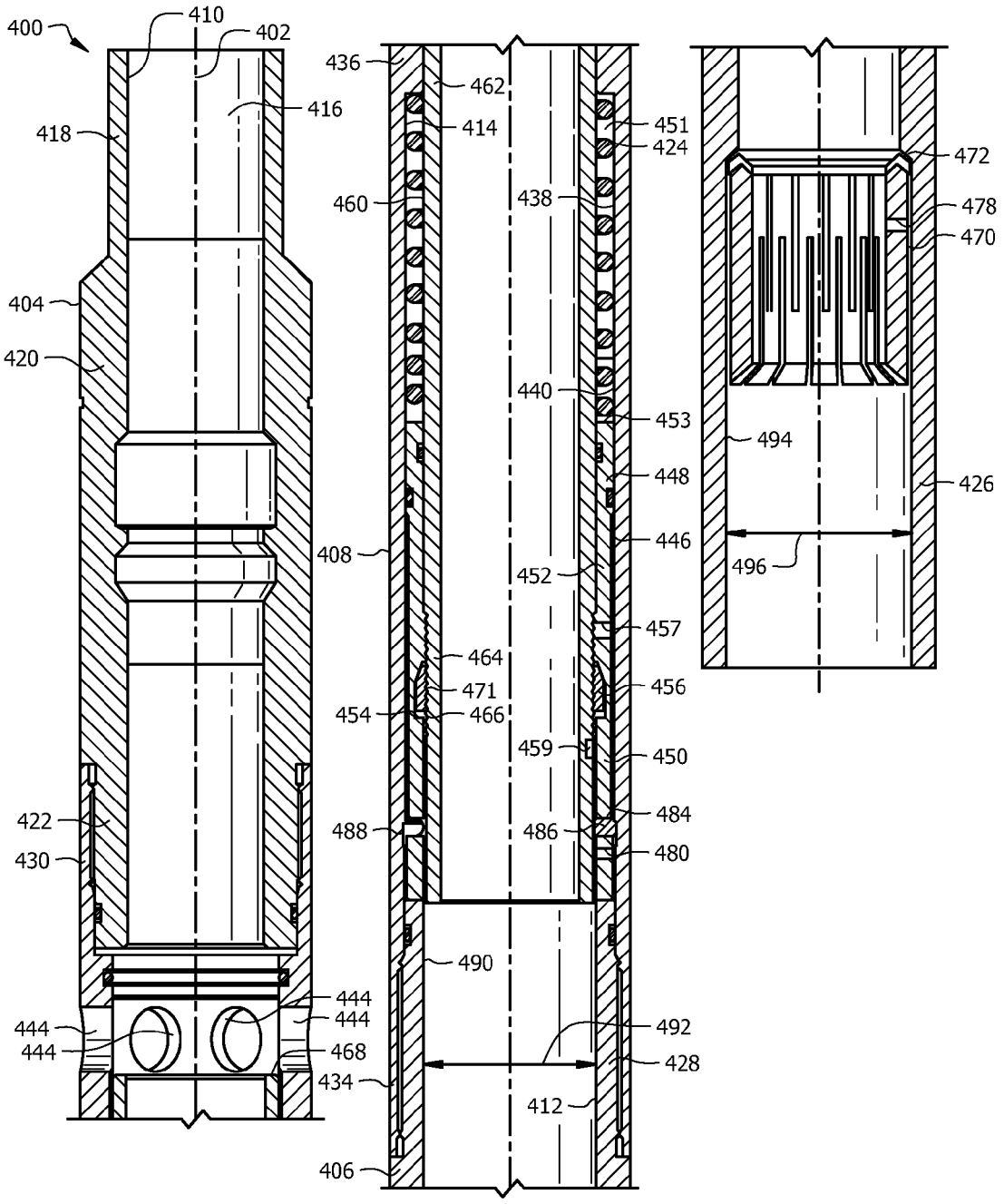
FIG. 8 is a cross-sectional view of the sleeve system of FIG. 5 showing the sleeve system in a fully open mode.

Referring now to FIGS. 5-8, a method of operating the sleeve system 400 is described below. Most generally, FIG. 5 shows the sleeve system 400 in an "installation mode" where sleeve 460 is at rest in position relative to the ported case 408 and so that the sleeve 460 prevents fluid communication between the sleeve flow bore 416 and the ports 444. It will be appreciated that sleeve 460 may be pressure balanced. FIG. 6 shows the sleeve system 400 in another stage of the installation mode where sleeve 460 is no longer restricted from moving relative to the ported case 408 by either the shear pin 482 or the lug 486, but remains restricted from such movement due to the presence of the shear pin 458. In the case where the sleeve 460 is pressure balanced, the pin 458 may primarily be used to prevent inadvertent movement of the sleeve 460 due to accidentally dropping the tool or other undesirable acts that cause the sleeve 460 to move due to undesired momentum forces. FIG. 7 shows the sleeve system 400 in a "delay mode" where movement of the sleeve 460 relative to the ported case 408 has not yet occurred but where such movement is contingent upon the occurrence of a selected wellbore condition. In this embodiment, the selected wellbore condition is the occurrence of a sufficient reduction of fluid pressure within the flow bore 416 following the achievement of the mode shown in FIG. 6. Finally, FIG. 8 shows the sleeve system 400 in a "fully open mode" where sleeve 460 no longer obstructs a fluid path between ports 444 and sleeve flow bore 416, but rather, a maximum fluid path is provided between ports 444 and the sleeve flow bore 416.

Referring now to FIG. 5, while the sleeve system 400 is in the installation mode, each of the piston 446, sleeve 460, seat gasket 472, and seat 470 are all restricted from movement along the central axis 402 at least because the shear pins 482, 458 lock the seat 470, piston 446, and sleeve 460 relative to the ported case 408. In this embodiment, the lug 486 further restricts movement of the piston 446 relative to the ported case 408 because the lug 486 is captured within the lug receptacle 484 of the piston 446 and between the seat 470 and the ported case 408. More specifically, the lug 486 is captured within the lug channel 488, thereby preventing movement of the piston 446 relative to the ported case 408. Further, in the installment mode, the spring 424 is partially compressed along the central axis 402, thereby biasing the piston 446 downward and away from the case shoulder 436. It will be appreciated that in alternative embodiments, the bias chamber 451 may be adequately sealed to allow containment of pressurized fluids that supply such biasing of the piston 446. For example, a nitrogen charge may be contained within such an alternative embodiment. It will be appreciated that the bias chamber 451, in alternative embodiments, may comprise one or both of a spring such as spring 424 and such a pressurized fluid.

Referring now to FIG. 6, the obturator 476 may be passed through a work string such as work string 112 until the obturator 476 substantially seals against the seat gasket 472 (as shown in FIG. 5). With the obturator 476 in place against the seat gasket 472, the pressure within the sleeve flow bore 416 may be increased uphole of the obturator 476 until the obturator 476 transmits sufficient force through the seat gasket 472 and the seat 470 to cause the shear pin 482 to shear. Once the shear pin 482 has sheared, the obturator 476 drives the seat gasket 472 and the seat 470 downhole from their installation mode positions. Such downhole movement of the seat 470 uncovers the lug 486, thereby disabling the positional locking feature formally provided by the lug 486. Nonetheless, even though the piston 446 is no longer restricted from uphole movement by the seat gasket 472, the seat 470, and the lug 486, the piston remains locked in position by the spring force of the spring 424 and the shear pin 458. Accordingly, the sleeve system remains in a balanced or locked mode, albeit a different configuration or stage of the installation mode. It will be appreciated that the obturator 476, the seat gasket 472, and the seat 470 continue downward movement toward and interact with the seat catch bore 494 in substantially the same manner the obturator 276, the seat gasket 272, and the seat 270 move toward and interact with the seat catch bore 304.

Referring now to FIG. 7, to initiate further transition from the installation mode to the delay mode, pressure within the flow bore 416 is increased until the piston 446 is forced upward and shears the shear pin 458. After such shearing of the shear pin 458, the piston 446 moves upward toward the case shoulder 436, thereby further compressing spring 424. With sufficient upward movement of the piston 446, the lower portion 450 of the piston 446 abuts the upper sleeve section 462. As the piston 446 travels to such abutment, the teeth 471 of c-ring 456 engage the teeth 466 of the lower sleeve section 464. The abutment between the lower portion 450 of the piston 446 and the upper sleeve section 446 prevents further upward movement of piston 446 relative to the sleeve 460. The engagement of teeth 471, 466 prevents any subsequent downward movement of the piston 446 relative to the sleeve 460. Accordingly, the piston 446 is locked in position relative to the sleeve 460 and the sleeve system 400 may be referred to as being in a delay mode.

While in the delay mode, the sleeve system 400 is configured to discontinue covering the ports 444 with the sleeve 460 in response to an adequate reduction in fluid pressure within the flow bore 416. For example, with the pressure within the flow bore 416 adequately reduced, the spring force provided by spring 424 eventually overcomes the upward forced applied against the piston 446 that is generated by the fluid pressure within the flow bore 416. With continued reduction of pressure within the flow bore 416, the spring 424 forces the piston 446 downward. Because the piston 446 is now locked to the sleeve 460 via the c-ring 456, the sleeve is also forced downward. Such downward movement of the sleeve 460 uncovers the ports 444, thereby providing fluid communication between the flow bore 416 and the ports 444. When the piston 446 is returned to its position in abutment against the lower adapter 406, the sleeve system 400 is referred to as being in a fully open mode. The sleeve system 400 is shown in a fully open mode in FIG. 8.

In some embodiments, operating a wellbore servicing system such as wellbore serving system 100 may comprise providing a first sleeve system (e.g., of the type of sleeve systems 200, 400) in a wellbore and providing a second sleeve system in the wellbore downhole of the first sleeve system. Next, wellbore servicing pumps and/or other equipment may be used to produce a fluid flow through the sleeve flow bores of the first and second sleeve systems. Subsequently, an obturator may be introduced into the fluid flow so that the obturator travels downhole and into engagement with the seat of the first sleeve system. When the obturator first contacts the seat of the first sleeve system, each of the first sleeve system and the second sleeve system are in one of the above-described installation modes so that there is not substantial fluid communication between the sleeve flow bores and the annulus of the wellbore through the ported cases of the sleeve systems. Accordingly, the fluid pressure may be increased to cause unlocking a restrictor of the first sleeve system in one of the above-described manners, thereby transitioning the first sleeve system from the installation mode to one of the above-described delayed modes.

In some embodiments, the fluid flow and pressure may be maintained so that the obturator passes through the first sleeve system in the above-described manner and subsequently engages the seat of the second sleeve system. The delayed mode of operation of the first sleeve system prevents fluid communication between the sleeve flow bore of the first sleeve and the annulus of the wellbore, thereby ensuring that no pressure loss attributable to such fluid communication prevents subsequent pressurization within the sleeve flow bore of the second sleeve system. Accordingly, the fluid pressure uphole of the obturator may again be increased as necessary to unlock a restrictor of the second sleeve system in one of the above-described manners. With both the first and second sleeve systems having been unlocked and in their respective delay modes, the delay modes of operation may be employed to thereafter provide and/or increase fluid communication between the sleeve flow bores and the annulus of the wellbore without adversely impacting an ability to unlock either of the first and second sleeve systems.

Further, it will be appreciated that one or more of the features of the sleeve systems may be configured to cause the relatively uphole located sleeve systems to have a longer delay periods before allowing substantial fluid communication between the sleeve flow bore and the annulus as compared to the delay period provided by the relatively downhole located sleeve systems. For example, the volume of the fluid chamber 268, the amount of and/or type of fluid placed within fluid chamber 268, the fluid metering device 291, and/or other features of the first sleeve system may be chosen differently and/or in different combinations from the related components of the second sleeve system in order to adequately delay provision of the above-described fluid communication until the second sleeve system is unlocked and/or otherwise transitioned into a delay mode of operation. In some embodiments, such first and second sleeve systems may be configured to allow substantially simultaneous and/or overlapping occurrences of providing substantial fluid communication (e.g., substantial fluid communication and/or achievement of the above-described fully open mode). However, in other embodiments, the second sleeve system may provide such fluid communication prior to such fluid communication being provided by the first sleeve system.

Referring now to FIG. 1, a method of servicing wellbore 114 using wellbore servicing system 100 is described. In some cases, wellbore servicing system 100 may be used to selectively treat selected ones of deviated zone 150, first, second, third, fourth, and fifth horizontal zones 150*a*-150*e* by selectively opening sleeve systems. More specifically, by using the above-described method of operating individual sleeve systems 200, 400 any one of the zones 150, 150*a*-150*e* may be treated using the respective associated sleeve systems 200, 400. It will be appreciated that sleeve systems 200*a*-200*e* are substantially similar to sleeve system 200 described above. It will be further appreciated that zones 150, 150*a*-150*e* may be isolated from one another, for example via swell packers, mechanical packers, sand plugs, sealant compositions (e.g., cement), or combinations thereof. While the following discussion is related to actuating two groups of sleeves (each group having three sleeves), it should be understood that such description is non-limiting and that any suitable number and/or grouping of sleeves may be actuated in corresponding treatment stages.

In some embodiments, where treatment of zones 150*a*, 150*b*, and 150*c* is desired without treatment of zones 150*d*, 150*e* and 150, sleeve systems 200*a*, 200*b*, and 200*c* may be provided with seats configured to interact with an obturator of a first configuration and/or size while sleeve systems 200*d*, 200*e*, and 200 are configured not to interact with the obturator having the first configuration. Accordingly, sleeve systems 200*a*, 200*b*, and 200*c* may be transitioned from installation mode to delay mode by passing the obturator having a first configuration through the uphole sleeve systems 200, 200*e*, and 200*d* and into successive engagement with sleeve systems 200*c*, 200*b*, and 200*a*. Since the sleeve systems 200*a*-200*c* comprise the fluid metering delay system, the various sleeve systems may be configured with fluid metering devices chosen to provide a controlled and/or relatively slower opening of the sleeve systems. For example, the fluid metering devices may be selected so that none of the sleeve systems 200*a*-200*c* actually provide fluid communication between their respective flow bores and ports prior to each of the sleeve systems 200*a*-200*c* having achieved transition from the locked mode to the delayed mode. In other words, the delay systems may be configured to ensure that each of the sleeve systems 200*a*-200*c* has been unlocked by the obturator prior to such fluid communication.

To accomplish the above-described treatment of zones 150*a*, 150*b*, and 150*c*, it will be appreciated that to prevent loss of fluid and/or fluid pressure through ports of sleeve systems 250*c*, 250*b*, each of sleeve systems 250*c*, 250*b* may each be provided with a fluid metering device that delays such loss until the obturator has unlocked the sleeve system 250*a*. It will further be appreciated that individual sleeve systems may be configured to provide relatively longer delays (e.g., the time from when a sleeve system is unlocked to the time that the sleeve system allows fluid flow through its ports) in response to the location of the sleeve system being located relatively further uphole from a final sleeve system that must be unlocked during the operation (e.g., in this case, sleeve system 200*a*). Accordingly, in some embodiments, a sleeve system 200*c* may be configured to provide a greater delay than the delay provided by sleeve system 200*b*. For example, in some embodiments where an estimated time of travel of an obturator from sleeve system 200*c* to sleeve system 200*b* is about 10 minutes and an estimated time of travel from sleeve system 200*b* to sleeve system 200*a* is also about 10 minutes, the sleeve system 200*c* may be provided with a delay of at least about 20 minutes. The 20 minute delay may ensure that the obturator can both reach and unlock the sleeve systems 200*b*, 200*a* prior to any fluid and/or fluid pressure being lost through the ports of sleeve system 200*c*.

Alternatively, in some embodiments, sleeve systems 200*c*, 200*b* may each be configured to provide the same delay so long as the delay of both are sufficient to prevent the above-described fluid and/or fluid pressure loss from the sleeve systems 200*c*, 200*b* prior to the obturator unlocking the sleeve system 200*a*. For example, in an embodiment where an estimated time of travel of an obturator from sleeve system 200*c* to sleeve system 200*b* is about 10 minutes and an estimated time of travel from sleeve system 200*b* to sleeve system 200*a* is also about 10 minutes, the sleeve systems 200*c*, 200*b* may each be provided with a delay of at least about 20 minutes. Accordingly, using any of the above-described methods, all three of the sleeve systems 200*a*-200*c* may be unlocked and transitioned into fully open mode with a single trip through the work string 112 of a single obturator and without unlocking the sleeve systems 200*d*, 200*e*, and 200 that are located uphole of the sleeve system 200*c*.

Next, if sleeve systems 200*d*, 200*e*, and 200 are to be opened, an obturator having a second configuration and/or size may be passed through sleeve systems 200*d*, 200*e*, and 200 in a similar manner to that described above to selectively open the remaining sleeve systems 200*d*, 200*e*, and 200. Of course, this is accomplished by providing 200*d*, 200*e*, and 200 with seats configured to interact with the obturator having the second configuration.

In alternative embodiments, sleeve systems such as 200*a*, 200*b*, and 200*c* may all be associated with a single zone of a wellbore and may all be provided with seats configured to interact with an obturator of a first configuration and/or size while sleeve systems such as 200*d*, 200*e*, and 200 may not be associated with the above-mentioned single zone and are configured not to interact with the obturator having the first configuration. Accordingly, sleeve systems such as 200*a*, 200*b*, and 200*c* may be transitioned from an installation mode to a delay mode by passing the obturator having a first configuration through the uphole sleeve systems 200, 200*e*, and 200*d* and into successive engagement with sleeve systems 200*c*, 200*b*, and 200*a*. In this way, the single obturator having the first configuration may be used to unlock and/or activate multiple sleeve systems (e.g., 200*c*, 200*b*, and 200*a*) within a selected single zone after having selectively passed through other uphole and/or non-selected sleeve systems (e.g., 200*d*, 200*e*, and 200).

An alternative embodiment of a method of servicing a wellbore may be substantially the same as the previous examples, but instead, using at least one sleeve system substantially similar to sleeve system 400. It will be appreciated that while using the sleeve systems substantially similar to sleeve system 400 in place of the sleeve systems substantially similar to sleeve system 200, a primary difference in the method is that fluid flow between related fluid flow bores and ports is not achieved amongst the three sleeve systems being transitioned from a locked mode to a fully open mode until pressure within the fluid flow bores is adequately reduced. Only after such reduction in pressure will the springs of the sleeve systems substantially similar to sleeve system 400 force the piston and the sleeves downward to provide the desired fully open mode.

Regardless of which type of the above-disclosed sleeve systems 200, 400 are used, it will be appreciated that use of either type may be performed according to a method described below. A method of servicing a wellbore may comprise providing a first sleeve system in a wellbore and also providing a second sleeve system downhole of the first sleeve system. Subsequently, a first obturator may be passed through at least a portion of the first sleeve system to unlock a restrictor of the first sleeve, thereby transitioning the first sleeve from a locked mode of operation to a delayed mode of operation. Next, the obturator may travel downhole from the first sleeve system to pass through at least a portion of the second sleeve system to unlock a restrictor of the second sleeve system. In some embodiments, the unlocking of the restrictor of the second sleeve may occur prior to loss of fluid and/or fluid pressure through ports of the first sleeve system.

In either of the above-described methods of servicing a wellbore, the methods may be continued by flowing wellbore servicing fluids from the fluid flow bores of the open sleeve systems out through the ports of the open sleeve systems. Alternatively and/or in combination with such outward flow of wellbore servicing fluids, wellbore production fluids may be flowed into the flow bores of the open sleeve systems via the ports of the open sleeve systems.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A wellbore servicing system, comprising:

a first sleeve system disposed in a wellbore, the first sleeve system comprising a first sliding sleeve at least partially carried within a first ported case, the first sleeve system being selectively restricted from movement relative to the first ported case by a first restrictor while the first restrictor is enabled, a first expandable seat configured to engage a first obturator and to disable the first restrictor, and a first delay system configured to selectively restrict movement of the first sliding sleeve relative to the first ported case while the first restrictor is disabled; and a second sleeve system disposed in the wellbore downhole of the first sleeve system, the second sleeve system comprising a second sliding sleeve at least partially carried within a second ported case, the second sliding sleeve being selectively restricted from movement relative to the second ported case by a second restrictor while the second restrictor is enabled, a second expandable seat configured to engage the first obturator and to disable the second restrictor, and a second delay system configured to selectively restrict movement of the second sliding sleeve relative to the second ported case while the second restrictor is disabled.

2. The wellbore servicing system according to claim 1, the first delay system comprising:

a fluid chamber formed between the first ported case and the first sliding sleeve; and a fluid metering device in fluid communication with the fluid chamber.

3. The wellbore servicing system according to claim 2, wherein fluid flow through the fluid metering device is prevented while the first restrictor is enabled.

4. The wellbore servicing system according to claim 3, wherein the first restrictor comprises a shear pin and wherein fluid flow through the metering device is allowed subsequent to shearing of the shear pin.

5. The wellbore servicing system according to claim 4, wherein the shear pin selectively restricts movement of the first expandable seat of the first sleeve system.

6. The wellbore servicing system according to claim 5, wherein the shear pin is received within each of a seat support of the first sleeve system and a lower adapter of the first sleeve system.

7. The wellbore servicing system according to claim 1, the first delay system comprising:

a piston carried at least partially within the first ported case; and a low pressure chamber formed between the piston and the first ported case.

8. The wellbore servicing system according to claim 1, the first restrictor comprising:

a piston at least partially received substantially concentrically between the first sliding sleeve and the first ported case.

9. The wellbore servicing system according to claim 8, wherein the first expandable seat is at least partially received within the piston, and further comprising:

a shear pin selectively received within the piston and the first expandable seat.

10. The wellbore servicing system according to claim 9, further comprising:

a lug selectively received through the piston and between the first expandable seat and the first ported case.

11. The wellbore servicing system according to claim 10, wherein the lug is selectively received within a lug channel of the first ported case.

12. The wellbore servicing system according to claim 8, further comprising:

a bias chamber at least partially defined by each of the first ported case, the first sliding sleeve, and the piston.

13. The wellbore servicing system according to claim 12, further comprising:

a spring received at least partially within the bias chamber.

14. The wellbore servicing system according to claim 1, further comprising:

the first obturator configured to be received by the first expandable seat and the second expandable seat, and to disable the first restrictor and the second restrictor.

15. A method of servicing a wellbore, comprising:

providing a first sleeve system in the wellbore and in association with a zone, the first sleeve system being initially configured in an installation mode where fluid flow between a flow bore of the first sleeve system and the wellbore via a port of the first sleeve system is restricted;

providing a second sleeve system in the wellbore, in association with the zone, and downhole of the first sleeve system, the second sleeve system being initially configured in an installation mode where fluid flow between a flow bore of the second sleeve system and the wellbore via a port of the second sleeve system is restricted;

passing an obturator through at least a portion of the first sleeve system, thereby unlocking a first restrictor of the first sleeve system and thereby commencing operation of the first sleeve system in a delayed mode; and passing the same obturator through at least a portion of the second sleeve system, thereby unlocking a second restrictor of the second sleeve system and thereby commencing operation of the second sleeve system in a delayed mode.

16. The method of claim 15, wherein the unlocking of the second restrictor is accomplished prior to allowing fluid flow between the flow bore of the first sleeve system and the wellbore via the port of the first sleeve system.

17. The method of claim 15, further comprising:

allowing the first sleeve system to transition from the delayed mode to a fully open mode whereby fluid flows between the flow bore of the first sleeve system and the wellbore via the port of the first sleeve system; and allowing the second sleeve system to transition from the delayed mode to a fully open mode whereby fluid flows between the flow bore of the second sleeve system and the wellbore via the port of the second sleeve system.

18. The method of claim 17, further comprising:

simultaneously communicating a wellbore servicing fluid to the first zone via the port of the first sleeve system and via the port of the second sleeve system.

19. The method of claim 15, wherein the first sleeve system comprises a first sliding sleeve at least partially carried within a first case comprising the port of the first sleeve system, the first sleeve system being selectively restricted from movement relative to the first case by the first restrictor while the first restrictor is enabled, a first expandable seat configured to engage the obturator and to disable the first restrictor, and a first delay system configured to selectively restrict movement of the first sliding sleeve relative to the first case while the first restrictor is disabled, and wherein the second sleeve system comprises a second sliding sleeve at least partially carried within a second case comprising the port of the second sleeve system, the second sliding sleeve being selectively restricted from movement relative to the second case by the second restrictor while the second restrictor is enabled, a second expandable seat configured to engage the obturator and to disable the second restrictor, and a second delay system configured to selectively restrict movement of the second sliding sleeve relative to the second case while the second restrictor is disabled.

20. A method of servicing a wellbore, comprising:

providing a first wellbore servicing tool and a second wellbore servicing tool in the wellbore and in association with a first zone; and performing an actuation action that enables fluid communication between the first zone and each of the first wellbore servicing tool and the second wellbore servicing tool, the actuation action being at least partially carried out in response to at least one of a fluid pressure and a fluid flow, wherein the actuation action comprises introducing an actuator to the first wellbore servicing tool and introducing the same actuator to the second wellbore servicing tool.

21. The method of servicing a wellbore of claim 20, further comprising:

prior to performing the actuation action, providing a third wellbore servicing tool in the wellbore and in association with a second zone that is located uphole of the first zone;

wherein the actuation action comprises introducing the same actuator to the third wellbore servicing tool prior to introducing the same actuator to either of the first wellbore servicing tool and the second wellbore servicing tool, and wherein fluid communication between the third wellbore servicing tool and the second zone is not enabled in response to the introduction of the same actuator to the third wellbore serving tool.

22. The method of claim 21, further comprising:

performing a second actuation action that enables fluid communication between the second zone and the third wellbore servicing tool and the second wellbore servicing tool.

23. The method of claim 22, wherein the second actuation action comprises introducing a second actuator to the third wellbore servicing tool.

24. The method of claim 20, further comprising:

simultaneously communicating a wellbore servicing fluid to the first zone via each of the first wellbore servicing tool and the second wellbore servicing tool.

25. A method of servicing a wellbore, comprising:

providing a first wellbore servicing tool and a second wellbore servicing tool in the wellbore and in association with a first zone; and performing an actuation action that enables fluid communication between the first zone and each of the first wellbore servicing tool and the second wellbore servicing tool, the actuation action being at least partially carried out in response to at least one of a fluid pressure and a fluid flow, wherein the actuation action affects the first wellbore servicing tool before the actuation action affects the second wellbore servicing tool, and wherein enablement of fluid communication between the first wellbore servicing tool and the first zone is at least one of delayed and restricted at least until the actuation action affects the second wellbore servicing tool.

26. A method of servicing a wellbore, comprising:

providing a first wellbore servicing tool and a second wellbore servicing tool in the wellbore and in association with a first zone; and performing an actuation action that enables fluid communication between the first zone and each of the first wellbore servicing tool and the second wellbore servicing tool, the actuation action being at least partially carried out in response to at least one of a fluid pressure and a fluid flow, wherein the first servicing tool comprises a first sliding sleeve at least partially carried within a first ported case, the first sleeve system being selectively restricted from movement relative to the first ported case by a first restrictor while the first restrictor is enabled, a first expandable seat configured to engage a first obturator and to disable the first restrictor, and a first delay system configured to selectively restrict movement of the first sliding sleeve relative to the first ported case while the first restrictor is disabled, and wherein the second servicing tool comprises a second sliding sleeve at least partially carried within a second ported case, the second sliding sleeve being selectively restricted from movement relative to the second ported case by a second restrictor while the second restrictor is enabled, a second expandable seat configured to engage the first obturator and to disable the second restrictor, and a second delay system configured to selectively restrict movement of the second sliding sleeve relative to the second ported case while the second restrictor is disabled.

* * * * *